US011746609B2

(12) United States Patent
Loh et al.

(10) Patent No.: US 11,746,609 B2
(45) Date of Patent: Sep. 5, 2023

(54) PRESSURE COMPENSATOR, METHOD FOR PRESSURE COMPENSATION, AND SYSTEM

(71) Applicants: Yuh Loh, Cypress, TX (US); Zhihui Zhang, Katy, TX (US)

(72) Inventors: Yuh Loh, Cypress, TX (US); Zhihui Zhang, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/526,512

(22) Filed: Nov. 15, 2021

(65) Prior Publication Data

US 2023/0151704 A1 May 18, 2023

(51) Int. Cl.

| | |
|---|---|
| ***E21B 21/08*** | (2006.01) |
| ***E21B 47/07*** | (2012.01) |
| ***E21B 7/00*** | (2006.01) |
| ***E21B 47/13*** | (2012.01) |
| ***E21B 47/06*** | (2012.01) |

(52) U.S. Cl.

CPC ..... *E21B 21/08* (2013.01); *E21B 7/00* (2013.01); *E21B 47/06* (2013.01); *E21B 47/07* (2020.05); *E21B 47/13* (2020.05); *E21B 2200/02* (2020.05)

(58) Field of Classification Search

CPC . E21B 21/08; E21B 7/00; E21B 47/07; E21B 47/13; E21B 2200/02; E21B 47/06

See application file for complete search history.

(56) References Cited

U.S. PATENT DOCUMENTS

| | | | | |
|---|---|---|---|---|
| 7,320,457 | B2 | 1/2008 | Heim et al. | |
| 7,559,358 | B2 * | 7/2009 | DiFoggio | F04B 47/00 166/66.6 |
| 10,641,086 | B2 * | 5/2020 | Lee | E21B 47/20 |
| 11,105,165 | B2 | 8/2021 | He et al. | |
| 11,274,501 | B2 * | 3/2022 | Shariff | E21B 33/128 |
| 11,346,161 | B2 * | 5/2022 | Albukhari | E21B 17/16 |
| 2003/0192687 | A1 | 10/2003 | Goodson et al. | |
| 2007/0128059 | A1 | 6/2007 | Bagwell | |
| 2015/0093257 | A1 | 4/2015 | Lastra | |

(Continued)

FOREIGN PATENT DOCUMENTS

WO 2003107523 A1 12/2003

OTHER PUBLICATIONS

Dong, et al.; "Development of ionic liquid-based electroactive polymer composites using nanotechnology"; Nanotechnology Reviews 2021; 10: 99-116; 8 pages.

(Continued)

*Primary Examiner* — Nicole Coy

(74) *Attorney, Agent, or Firm* — CANTOR COLBURN LLP

(57) ABSTRACT

A pressure compensator including a housing, an electroactive polymer (EAP) disposed in the housing and defining a volume therein, the volume being changeable upon application of an electric signal. A method for managing pressure in a tool including applying an electrical signal to the pressure compensator and changing a shape of the EAP to change the volume of the compensator whereby the pressure in the tool is altered. A borehole system including a borehole in a subsurface formation, a string in the borehole, a pressure compensator disposed within or as a part of the string.

12 Claims, 3 Drawing Sheets

(56) References Cited

U.S. PATENT DOCUMENTS

| | | | | |
|---|---|---|---|---|
| 2018/0171766 | A1 | 6/2018 | Clingman et al. | |
| 2020/0108223 | A1 | 4/2020 | Koninklije | |
| 2021/0131209 | A1 | 5/2021 | He et al. | |
| 2021/0372224 | A1* | 12/2021 | Tyler | F16J 15/54 |

OTHER PUBLICATIONS

Notification of Transmittal of the International Search Report and the Written Opinion of the International Searching Authority, or the Declaration; PCT/US2022-048559; dated Mar. 13, 2023; 13 pages.

* cited by examiner

PRESSURE COMPENSATOR, METHOD FOR PRESSURE COMPENSATION, AND SYSTEM

BACKGROUND

In the resource recovery and fluid sequestration industries pressure compensation is a pervasive issue. It is desirable to compensate for pressure changes in the environment where a tool is used to reduce requirements for collapse and burst resistance as well as to manage pressure due to temperature for example both during use and during maintenance of the tool. Innovation in pressure compensation for downhole tools is always well received.

SUMMARY

An embodiment of a pressure compensator including a housing, an electroactive polymer (EAP) disposed in the housing and defining a volume therein, the volume being changeable upon application of an electric signal.

A method for managing pressure in a tool including applying an electrical signal to the pressure compensator, and changing a shape of the EAP to change the volume of the compensator whereby the pressure in the tool is altered.

An embodiment of a borehole system including a borehole in a subsurface formation, a string in the borehole, a pressure compensator disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
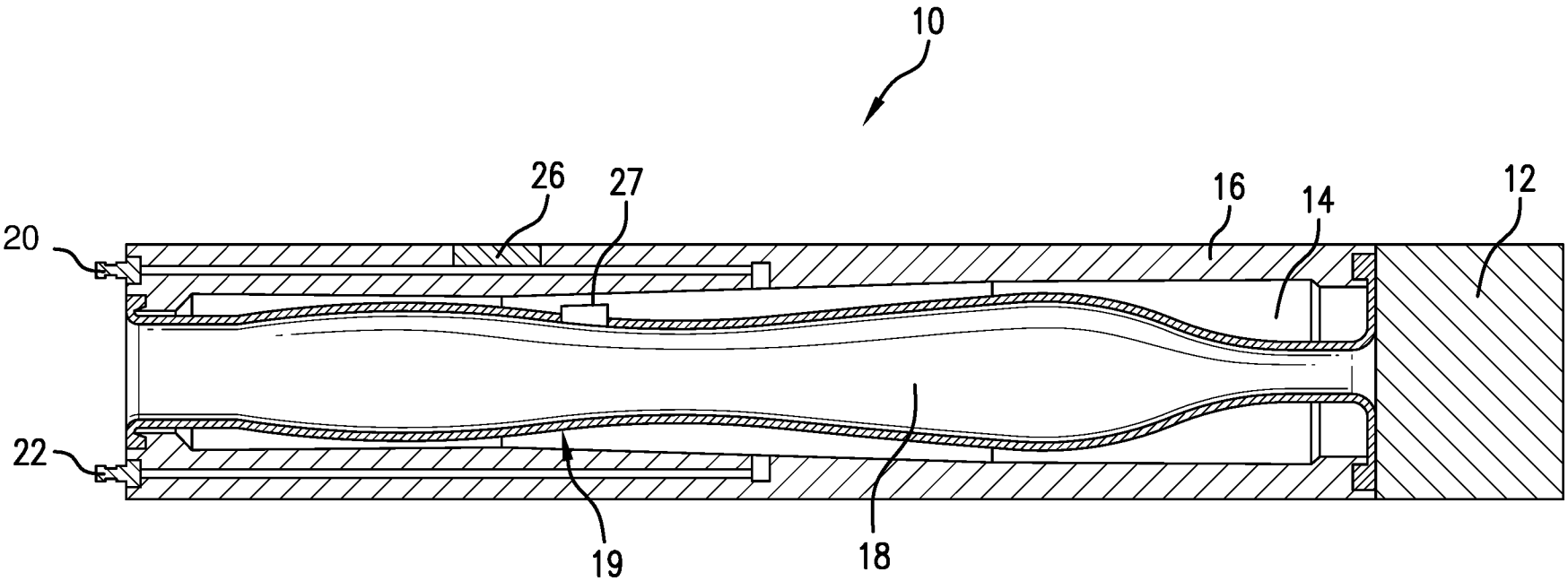
FIG. 1 is a cross sectional schematic view of a pressure compensator that may be appended to a downhole tool that requires pressure compensation.

Referring to FIG. 1, a pressure compensator 10 is illustrated apart from any components with which it may be associated. More particularly, it is to be understood that the pressure compensator may be connected to another tool that requires pressure compensation. Such other tools are represented by a box 12 attached to the compensator 10. The compensator 10 is to be fluidly connected to a fluid volume of the tool 12. While the compensator 10 is illustrated in tubular form, it should be understood that other forms are also possible that employ the fact that an electroactive polymer (EAP) 14, which makes up a portion of the compensator 10 is capable of changing its volume based upon an electrical trigger. The electrical trigger may be applied voltage or may be an applied current depending upon type of EAP is used. EAP is a commercially available substance and need not be specifically described herein.

The compensator 10, as illustrated, comprises a housing 16 within which is placed an annular segment of EAP 14. The EAP 14 defines a volume 18 therein. In some embodiments, there is also, optionally, a membrane 19 that may be in the form of a bladder that segregated the EAP from fluid within the volume 18. In some instances, this embodiment may be useful since some fluids may be corrosive or highly conductive, etc. The EAP 14 is also connected to an electrode 20 and in some embodiments includes a second electrode 22. The electrode participates in an electrical pathway that enables the application of voltage or current to the EAP 14 hence causing the EAP 14 to change shape and consequently change the volume 18. Changing of the volume 18 will cause a change in pressure of any fluid exposed thereto. If the change in shape makes the volume 18 larger, then the pressure of fluid in contact therewith will go down. Oppositely, if the EAP 14 is made to change shape in a way that causes the volume 18 to grow, then the pressure of fluid exposed thereto will go down.

In embodiments a controller 26 is included that comprises a pressure and/or temperature sensor 27 that is in sensory communication with the fluid in the volume 18. When threshold parameters for one or the other of pressure or temperature or both are met, the controller sends an appropriate electrical signal to the EAP 14 and either increases or reduces the volume 18.

Figure 2:
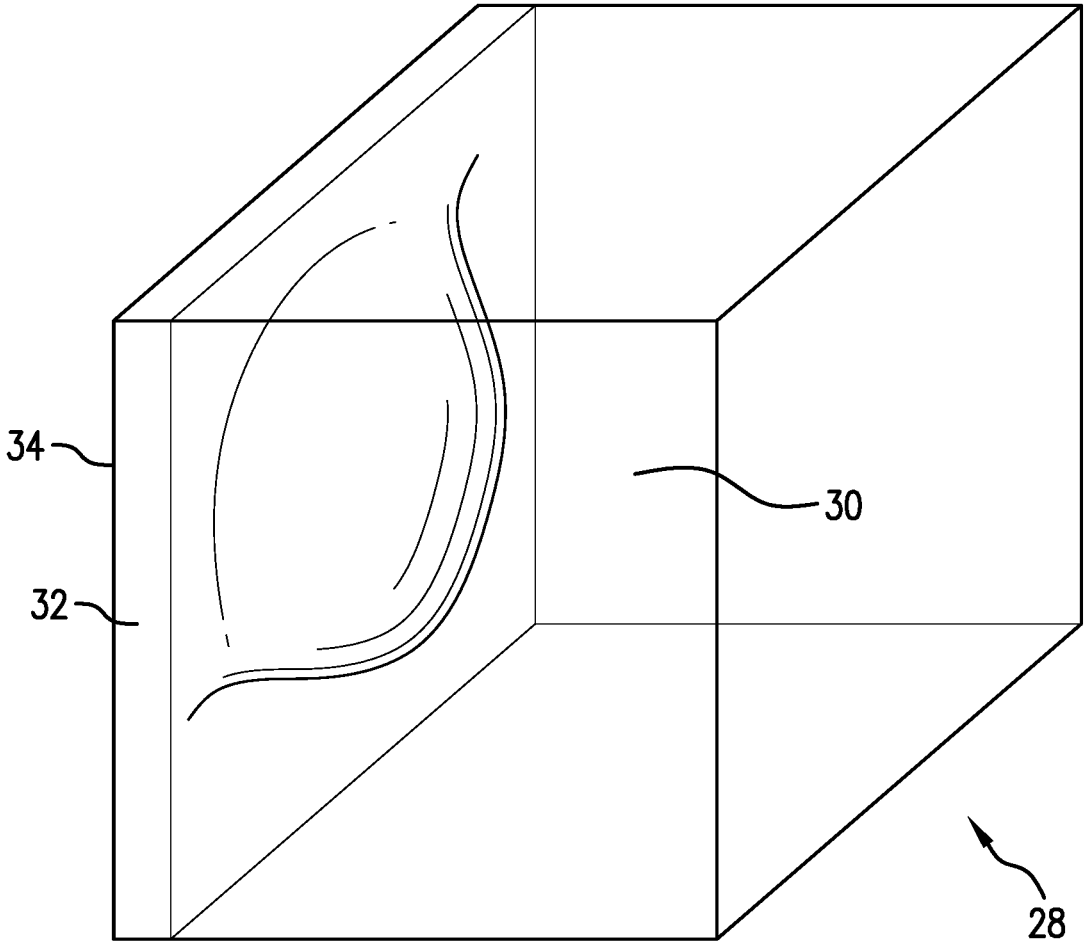
FIG. 2 is a schematic representation of another embodiment that will like FIG. 1 be fluidly connected to a tool.

While FIG. 1 shows the EAP 14 in an annular shape, it is also contemplated that other shapes be used. FIG. 2 is a schematic view of a compensator 28 having a cubic volume 30 that includes one or more walls that are made from or that support a layer of EAP 32. Depending upon what thresholds are set for EAP 32 action, the EAP 32 may protrude into the volume 30 as illustrated or be flat against wall 34. A cube is illustrated for convenience. In fact, however, any geometric shaped volume may be affected in displacement by employing EAP on or as one or more of the walls of the geometric shape. Triggering of the EAP through a controller or automatically through the use of conductors 36 and 38 (see FIG. 1), for example, that close a circuit if water is present, causes a change in the volume 18 or 30 that brings with it a change in pressure.

One example for use is a downhole tool that is brought back to surface and is still hot from being in the hole. The pressure inside due to temperature would be too high to effect maintenance on the tool and delay would ensue while awaiting the internal temperature and hence the internal pressure to abate. With the compensator 10 however, the pressure inside of the tool may be relieved by activating the EAP to increase volume size thereby reducing pressure.

Figure 3:
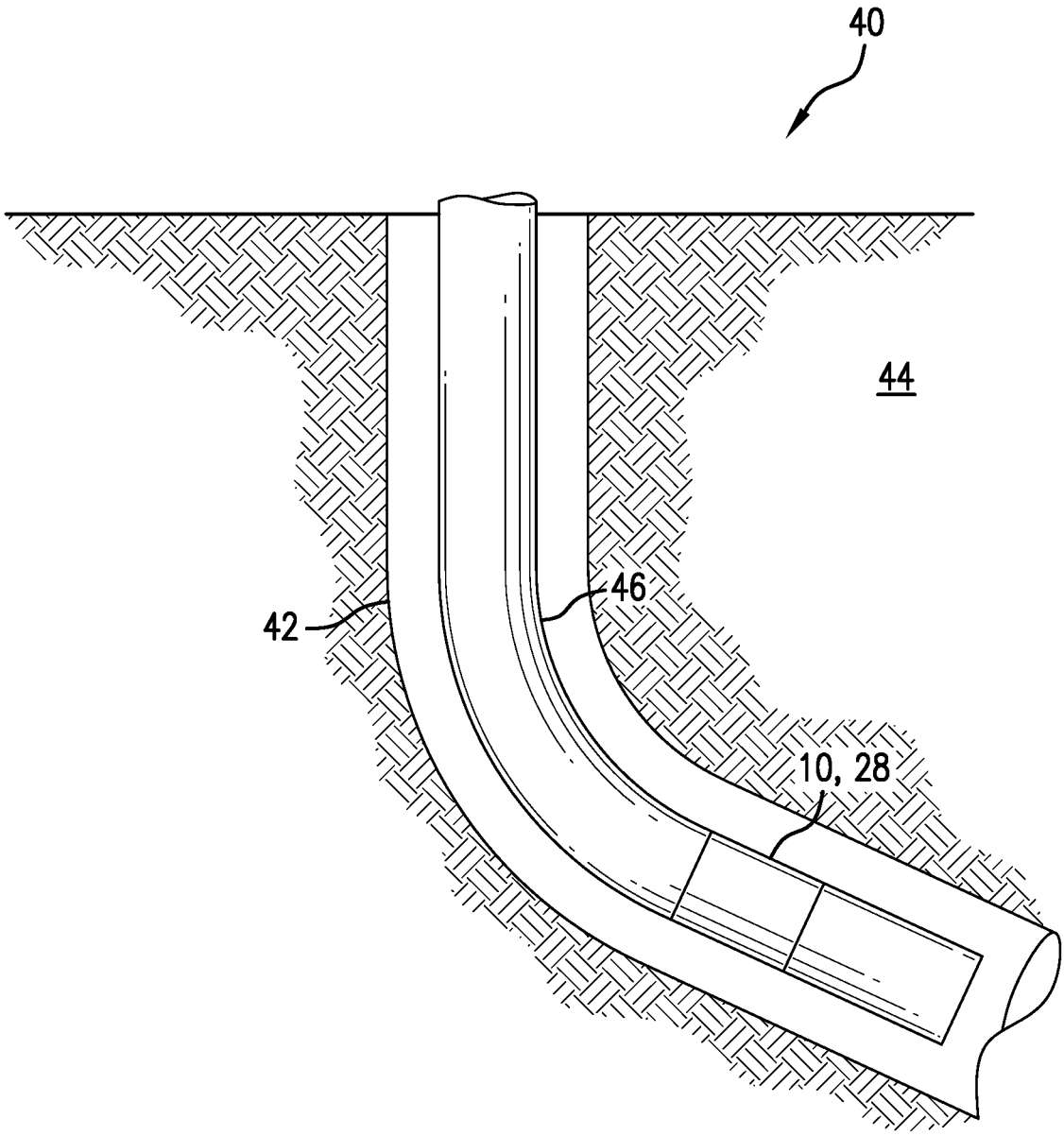
FIG. 3 is a view of a borehole system including the pressure compensator disclosed herein.

Referring to FIG. 3, a borehole system 40 is illustrated. System 40 includes a borehole 42 extending in a subsurface formation 44. A string 46 is disposed within the borehole 42. A pressure compensator 10 or 28 is disposed within or as a part of the string 46. The pressure compensator 10, 28 may be fluidly connected to a downhole tool 12.

Set forth below are some embodiments of the foregoing disclosure:

Embodiment 1: A pressure compensator including a housing, an electroactive polymer (EAP) disposed in the housing and defining a volume therein, the volume being changeable upon application of an electric signal.

Embodiment 2: The compensator as in any prior embodiment, wherein the volume is fluidly connected to an internal volume of an associated tool.

Embodiment 3: The compensator as in any prior embodiment, wherein the EAP is annular shaped.

Embodiment 4: The compensator as in any prior embodiment, wherein the electric signal is one of voltage or current.

Embodiment 5: The compensator as in any prior embodiment, further comprising a controller electrically connected to the EAP.

Embodiment 6: The compensator as in any prior embodiment, further comprising a sensor functionally connected to the controller.

Embodiment 7: The compensator as in any prior embodiment, wherein the sensor is one or more of a temperature sensor and a pressure sensor.

Embodiment 8: The compensator as in any prior embodiment, wherein the controller dictates when a change signal is presented to the EAP.

Embodiment 9: The compensator as in any prior embodiment, wherein the controller is autonomous.

Embodiment 10: A method for managing pressure in a tool including applying an electrical signal to the pressure compensator as in any prior embodiment, and changing a shape of the EAP to change the volume of the compensator whereby the pressure in the tool is altered.

Embodiment 11: The method as in any prior embodiment, further including sensing at least one of temperature and pressure in the tool.

Embodiment 12: The method as in any prior embodiment, further comprising determining whether the sensed temperature and/or pressure exceeds a threshold and then initiating the shape change of the EAP.

Embodiment 13: A borehole system including a borehole in a subsurface formation, a string in the borehole, a pressure compensator as in any prior embodiment disposed within or as a part of the string.

Embodiment 14: The system as in any prior embodiment wherein the pressure compensator is fluidly connected to a tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A pressure compensator system comprising:

a housing configured for connection to a tool creating a contained fluid volume, wherein the tool requires pressure compensation;

an electroactive polymer (EAP) disposed in the housing and defining a volume therein, the EAP volume being changeable upon application of an electric signal, that causes a change in pressure of a fluid in the contained fluid volume to compensate pressure in the tool, during use.

2. The compensator system as claimed in claim 1, wherein the EAP is annular shaped.

3. The compensator system as claimed in claim 1, wherein the electric signal is one of voltage or current.

4. The compensator system as claimed in claim 1, further comprising a controller electrically connected to the EAP.

5. The compensator system as claimed in claim 4, further comprising a sensor functionally connected to the controller.

6. The compensator system as claimed in claim 5, wherein the sensor is one or more of a temperature sensor and a pressure sensor.

7. The compensator system as claimed in claim 4, wherein the controller dictates when a change signal is presented to the EAP.

8. The compensator system as claimed in claim 4, wherein the controller is autonomous.

9. A method for managing pressure in a tool comprising:

applying an electrical signal to the pressure compensator as claimed in claim 1; and changing a shape of the EAP to change the volume of the compensator whereby the pressure in the tool is altered.

10. The method as claimed in claim 9, further including sensing at least one of temperature and pressure in the tool.

11. The method as claimed in claim 10, further comprising determining whether the sensed temperature and/or pressure exceeds a threshold and then initiating the shape change of the EAP.

12. A borehole system comprising:

a borehole in a subsurface formation;

a string in the borehole;

a pressure compensator system as claimed in claim 1 disposed within or as a part of the string.

* * * * *